United States Patent [19]

Mukai et al.

[11] Patent Number: 4,748,472

[45] Date of Patent: May 31, 1988

[54] DEVELOPING APPARATUS WITH MULTIPLE BLADE DEVELOPER CONDITIONER

[75] Inventors: Hideo Mukai; Tomoyuki Asada, both of Yokohama, Japan

[73] Assignee: Kabushiki Kaisha Toshiba, Kawasaki, Japan

[21] Appl. No.: 14,776

[22] Filed: Feb. 13, 1987

[30] Foreign Application Priority Data

May 26, 1986 [JP] Japan ..... 61-120892

[51] Int. Cl.[4] ..... G03G 15/00; G03G 15/08

[52] U.S. Cl. ..... 355/3 DD; 118/653

[58] Field of Search ..... 355/3 DR, 3 DD, 14 D; 118/652, 653, 656, 657, 658; 430/107, 120, 903

[56] References Cited

U.S. PATENT DOCUMENTS

| | | | |
|---|---|---|---|
| 4,194,830 | 3/1980 | Ohnuma et al. | 118/656 |
| 4,392,735 | 7/1983 | Oka | 355/3 DD |
| 4,406,535 | 9/1983 | Sakamoto et al. | 355/3 DD |
| 4,458,627 | 7/1984 | Hosono et al. | 118/657 |
| 4,521,098 | 6/1985 | Hosoya et al. | 355/3 DD |
| 4,566,402 | 1/1986 | Shimazaki | 118/653 |
| 4,586,460 | 5/1986 | Kohyama et al. | 118/653 |
| 4,632,535 | 12/1986 | Nagata | 355/3 DD |

FOREIGN PATENT DOCUMENTS

| | | | |
|---|---|---|---|
| 196231 | 10/1986 | European Pat. Off. | 355/3 DD |

*Primary Examiner*—R. L. Moses
*Assistant Examiner*—Ed Pipala
*Attorney, Agent, or Firm*—Foley & Lardner, Schwartz, Jeffery, Schwaab, Mack, Blumenthal & Evans

[57] ABSTRACT

In a developing apparatus for developing an electrostatic latent image by applying a charged developer to the latent image formed on the surface of an image carrier, a housing, stored with the developer, is provided with a developing roller for feeding the developer therefrom to a developing position. A plurality of blades are pressed against the developing roller, whereby the developer is triboelectrically charged.

18 Claims, 3 Drawing Sheets

DEVELOPING APPARATUS WITH MULTIPLE BLADE DEVELOPER CONDITIONER

BACKGROUND OF THE INVENTION

The present invention relates to a developing apparatus for applying a developer onto a latent image formed on an image carrier to develop the latent image.

One-component developers or two-component developers are used in developing apparatuses of this type. A two-component developer includes a toner contributing to development and a carrier for properly charging this toner. However, in such a two-component developer, a mixing ratio of the toner to the carrier must be kept constant. In other words, the toner concentration must be kept constant. However, it is difficult to maintain a constant toner concentration. On the other hand, a one-component developer has an advantage in that the concentration control is not necessary since only the toner for contributing to development is contained in the developer.

One-component developers are classified into magnetic and nonmagnetic developers. Magnetic developers contain magnetic materials in the nonmagnetic developer particles. When such a magnetic developer is used in a conventional apparatus, a magnet is arranged on the inside of a developer carrier for carrying the developer into the developing position and generating a magnetic field for supporting and carrying the developer. The following problems occur when the magnetic developer is used.

(1) The developer carrier becomes complicated, expensive and large since the magnet must be supported by the developer carrier.

(2) A magnetic developer containing magnetic particles is more expensive than a nonmagnetic developer.

(3) Since a magnetic developer contains magnetic particles which do not contribute to development, color reproducibility is not very satisfactory. As a result, it is difficult to perform color development using a magnetic developer.

These problems can be settled effectively with use of developing apparatuses which employ a one-component nonmagnetic developer. As an example of the apparatuses of this type, there is a developing apparatus which is disclosed in U.S. Pat. No. 4,521,098 by Hosoya et al. In this prior art apparatus, a thin layer of a toner, for use as the one-component nonmagnetic developer, is formed on a developing roller, and is pressed by a blade. Thereupon, the toner is charged triboelectrically by the blade, and then it is fed to a photosensitive drum on which an electrostatic latent image is formed.

In this manner, the toner on the developing roller can be charged only once, so that all of toner particles cannot be charged securely and fully. If the toner is charged insufficiently, then the toner particles may scatter or cause fogging, thus failing to produce a clear image.

SUMMARY OF THE INVENTON

The object of the present invention is to provide a developing apparatus capable of charging a toner securely and fully for obtaining a clear image.

According to an aspect of the present invention, there is provided a developing apparatus for developing an electrostatic latent image by applying a developer to the latent image, formed on the surface of an image carrier at a developing position, facing the image carrier, the apparatus comprising a housing for containing the developer, a developer carrier for carrying the developer from the housing to the developing position, and a plurality of blades pressed against the developer carrier so as to triboelectrically charge the developer on the developer carrier.

When the developer carrier supplies the developer to the electrostatic latent image, in the developing apparatus of the invention, the developer can be charged first by a first elastic blade, and then by a second elastic blade. Thus, even if insufficiently charged developer particles exist in a developer layer, formed by the first blade, they can be charged fully by the second blade, which is disposed next to the first blade. In consequence, if the developer used has low chargeability, it can be prevented from scattering or causing fogging, thus permitting production of a satisfactory image.

DETAILED DESCRIPTION OF THE PREFERRED EMBODIMENT

An embodiment of the present invention will now be described in detail with reference to the accompanying drawings of FIGS. 1 to 4.

Figure 1:
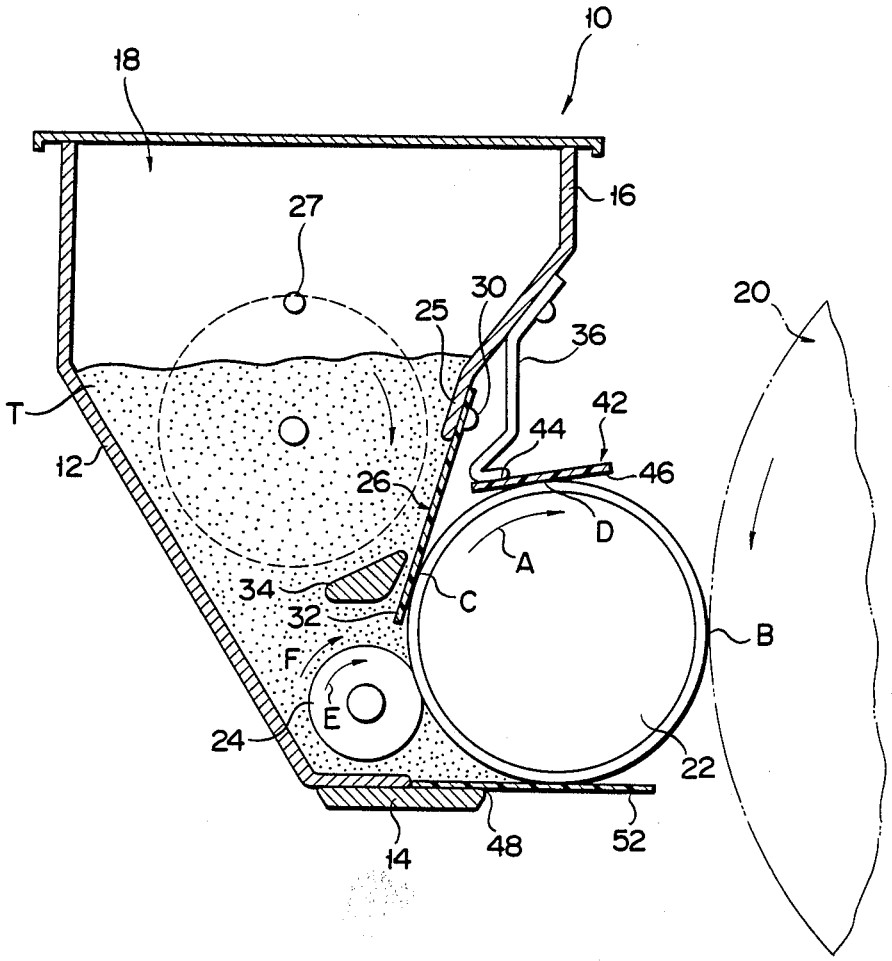
FIG. 1 is a schematic sectional view of a developing apparatus according to an embodiment of the present invention.

Developing apparatus 10 according to the embodiment of the invention is provided with hopper 18, which includes back frame 12, bottom frame 14, and front frame 16, as shown in FIG. 1. Nonmagnetic developer T, as a developing agent, is contained in hopper 18. Developing roller 22 is located between bottom and front frames 14 and 16, in hopper 18. The roller serves to transport the developer from hopper 18 toward photosensitive drum 20, on which an electrostatic latent image is formed. Roller 22 and drum 20 are facing and close to each other, with gap B between them. Roller 22 is rotatable in synchronism with drum 20, in the direction of arrow A of FIG. 1. Thus, the developing roller, held between frames 14 and 16, is located within hopper 18, on one side of the frames, and is exposed to the outside on the other side or the drum side.

Developing roller 22 includes a sleeve formed of aluminum. The outer surface of the sleeve is sandblasted, and coated with a nickel layer 10-μm thick by electroless plating. After the plating, the surface roughness of the sleeve is about 1 μm.

Photosensitive drum 20 has a negative polarity. The electric charge of the toner is approximately +12 μC/g. Between drum 20 and developing roller 22 is about 300 μm wide. The potential of drum 20 is set to −500V, and a superposed voltage of photosensitive drum 20 is 600V and a DC voltage of −200V, is applied to roller 22 and drum 20 at a frequency of 2 kHz.

Feed roller 24 is located in hopper 18, in close proximity to bottom frame 14. It serves both to transport developer T toward developing roller 22 and to press the developer against roller 22. Feed roller 24 is in rolling contact with the developing roller, with a bite about 0.3 mm deep. Roller 24 is formed of polyurethane.

Stirring member 27 is located substantially in the center of hopper 18, whereby the developer in the hopper is stirred.

Proximal end portion 28 of first elastic blade 26 is attached to lower end portion 25 of front frame 16 by means of screw 30. Blade 26 serves to form and charge a thin film layer of the developer. Free end portion 32 of blade 26 is pressed against developing roller 22, at a point above the contact point between roller 22 and feed roller 24. In this case, end portion 32 of blade 26 extends diagonally into hopper 18, from end portion 25 of front frame 16, thus keeping toner T inside the hopper. First blade 26, formed of stainless steel, has a thickness of about 0.15 mm.

Figure 2:
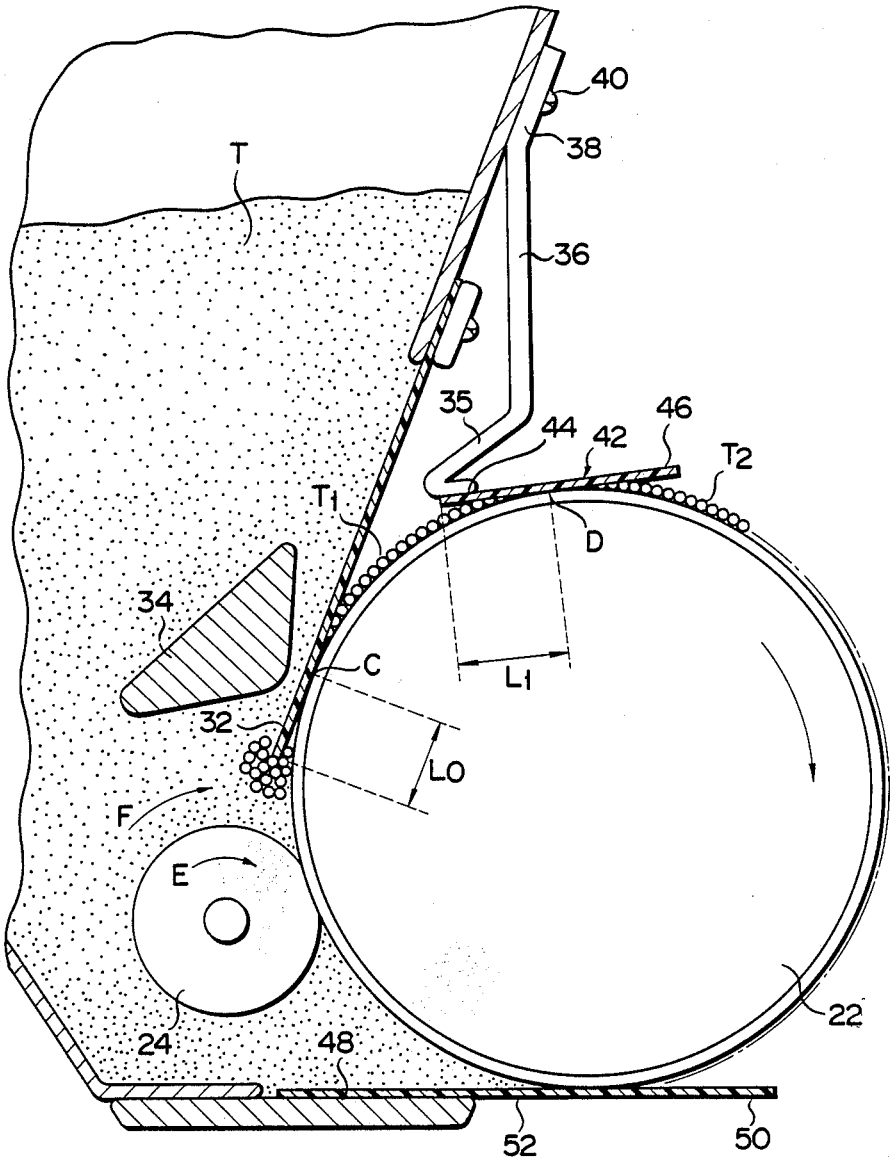
FIG. 2 is an enlarged sectional view showing the principal part of the developing apparatus shown in FIG. 1.

As shown in FIG. 2, free end portion 32 of first blade 26 is in contact with developing roller 22, at contact point C. Distance $L_0$ between point C and the free end of blade 26 is adjusted to a predetermined value, about 2 mm.

Inside hopper 18, moreover, baffle plate 34 is located over feed roller 24, in close proximity to the free end portion 32 of first blade 26. Plate 34 has a substantially triangular section, one side of which faces roller 24.

Proximal end portion 38 of bracket 36 is fixed to that portion of front frame 16 over lower end portion 25 thereof. Bracket 36 extends downward, and its distal end portion 35 is substantially L-shaped. Proximal end portion 44 of second elastic blade 42 is fixed to end portion 35 of bracket 36, and free end portion 46 of blade 42 extends substantially horizontally. The central portion of second blade 42 is in contact with developing roller 22, at contact point D. Distance $L_1$ between point D and the proximal end of blade 42 is adjusted to a predetermined value, about 3 mm.

The relationship between distances $L_0$ and $L_1$ will now be described.

Distance $L_0$ is always shorter than distance $L_1$ ($L_0<L_1$). Preferably, distance $L_0$ ranges from 0.5 to 3.0 mm. The thickness of toner layer $T_1$ on developing roller 22 depends on distance $L_0$. Thus, the longer distance $L_0$ is set, the thicker layer $T_1$ becomes.

Preferably, moreover, distance $L_1$ is longer than $L_0$ by 0.5 to 1.0 mm. With this arrangement, toner layer $T_1$, formed by first blade 26, can be in contact with second blade 42 at point D, without being scraped off. Thus, blade 42 presses toner layer $T_1$ without regulating its thickness, thus only charging the toner triboelectrically. At contact point C, first blade 26 presses developing roller 22 with a pressure of about 40 to 100 g/cm$^2$ (about 60 g/cm$^2$ in this embodiment). At point D, second blade 42 presses roller 22 with a pressure of about 40 g/cm$^2$, which is about 20 g/cm$^2$ lower than the pressure of the first blade.

Proximal end portion 48 of recovery blade 52 is fixed to bottom frame 14 of hopper 18. Free end portion 50 of blade 52 extends substantially horizontally, and is in contact with developing roller 22. Blade 52, which is formed of Mylar (trademark), has a thickness of about 150 μm. It is pressed against roller 22, on the lower-course side of gap B between roller 22 and photosensitive drum 20, with respect to the rotating direction of roller 22 as indicated by arrow A. As roller 22 rotates, residual toner T, remaining on drum 20 without having contributed to development, is transported past recovery blade 52, to be fed back into hopper 18.

The operation of the present embodiment will now be described.

When feed roller 24 rotates in the direction of arrow E, toner particles around roller 24 flow toward developing roller 22. This toner flow produces a flow which passes under free end portion 32 of first blade 26. However, most of the toner particles cause a flow which goes over end portion 32 of blade 26, thus whirling up within hopper 18. The upward toner flow runs against baffle plate 34, to be redirected toward feed roller 24. Thus, space F, defined by plate 34 and rollers 24 and 22, is densely filled with toner T which is carried by the flow caused by the rotation of roller 24 and the flow redirected toward roller 24 by plate 34. Accordingly, the toner pressure in the vicinity of free end portion 32 of blade 26, which is most essential to toner coating, can always be increased satisfactorily. In consequence, the quantity of the toner flow, caused by the rotation of roller 24, cannot be influenced by the quantity of toner in hopper 18.

Since the capacity of space F is smaller than that of hopper 18, space F can be filled with toner continually under a predetermined pressure, even though the toner in hopper 18 is reduced. More specifically, the toner can be fed, at a constant pressure, into the region between the free end of first blade 26, extending into space F, and developing roller 22, without regard to the toner quantity in hopper 18.

The toner held between first blade 26 and developing roller 22 is pressed against roller 22, at contact point C, by blade 26. After passing point C, toner T is attached to roller 22, in the form of a thin film layer about 30 μm thick. In the meantime, the toner is charged triboelectrically, as specified.

Most of the toner particles on developing roller 22 are charged as they pass by first blade 26. If the chargeability of the toner is not good, however, some of the toner particles are insufficiently charged. The defectively charged toner particles may scatter or cause fogging during development on photosensitive drum 20. In order to prevent this, these toner particles are recharged triboelectrically by second blade 42.

Thus, after toner layer $T_1$ is delivered to second blade 42, to be transported under proximal end portion 44, it is pressed against roller 22, at contact point D, by blade 42. As a result, layer $T_1$ is recharged triboelectrically. Since the toner is charged substantially twice, in this manner, those toner particles on developing roller 22 can be securely and fully charged.

As mentioned before, distance $L_1$, or the length of the proximal end portion of second blade 42, is longer than distance $L_0$, or the length of the free end portion of first blade 26. Therefore, toner layer $T_1$, formed by first blade 26, is not scraped off, so that the thickness of toner layer $T_2$, coming out from under second blade 42, is equal to that of layer $T_1$. In other words, the thickness of the toner layer is set only by adjusting distance $L_0$ for first blade 26.

If the toner scraped by second blade 42 is too much, some toner particles will stay and accumulate between first and second blades 26 and 28, thus requiring a complicated disposal mechanism. Moreover, if the scraped toner is left as it is, for a long time, until its charge leaks, it will be charged by second blade 42 only, leaving some toner particles only partially charged. In this embodiment, however, second blade 42 is prevented from scraping off the toner, so that there is no possibility of such defective charging.

Toner layer $T_2$, charged triboelectrically by second blade 42, is transported to gap B, where it is opposed to photosensitive drum 20. Then, toner particles fly and electrostatically stick to the electrostatic latent image on drum 20, thereby developing the latent image.

The residual toner particles, remaining on drum 20 without having contributed to the development, are fed back into hopper 18 via recovery blade 52.

Figure 3:
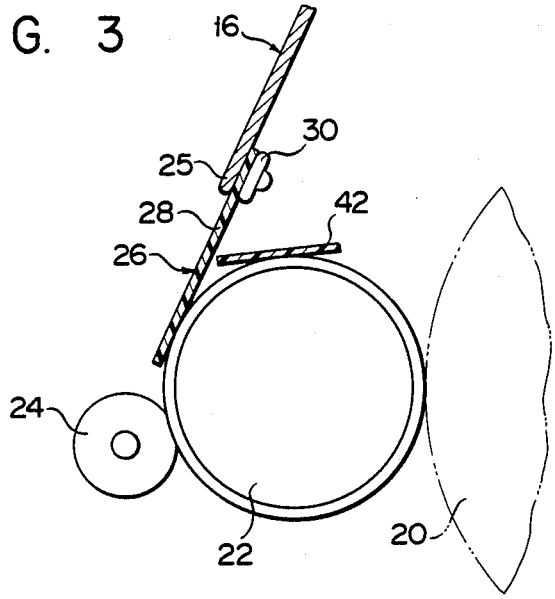
FIG. 3 is a schematic sectional view showing the principal part of a developing apparatus according to a modification of the embodiment shown in FIG. 1.
Figure 4:
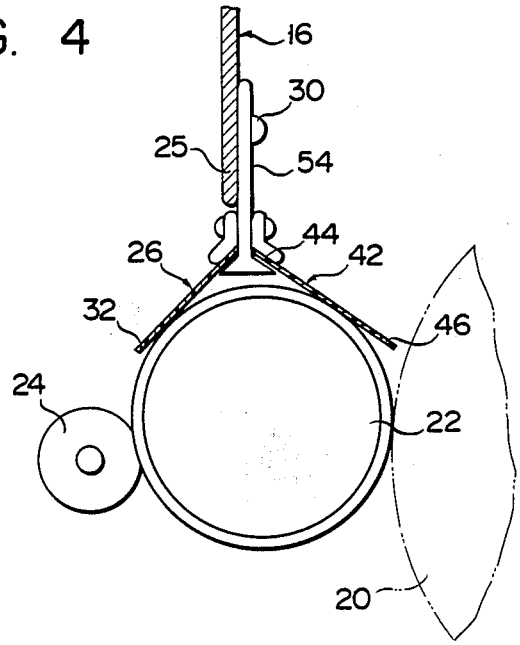
FIG. 4 is a schematic sectional view showing the principal part of a developing apparatus according to another modification of the embodiment shown in FIG. 1.

Referring now to FIGS. 3 and 4, modifications of the aforementioned embodiment will be described. In the description to follow, like reference numerals are used to designate like portions as in the first embodiment, and a detailed description of those portions is omitted.

In the modification shown in FIG. 4, proximal end portions 28 and 30 of first and second blades 26 and 42 are stuck together, and the joint is attached to lower end portion 25 of front frame 16 by means of screw 30. This modification is advantageous in that the two blades can be mounted simultaneously in a single operation. Since the blades are attached to one common spot, moreover, the components used in the developing apparatus can be reduced in number, thus simplifying the construction of the apparatus.

In the second modification shown in FIG. 4, first and second blades 26 and 42 are attached bifurcately to the lower end portion of bracket 54. The upper end portion of bracket 54 is attached to lower end portion 25 of front frame 16 by means of screw 30. In this modification, distance $L_0$ (see FIG. 2) and the pressure of contact between developing roller 22 and blades 26 and 42 can be adjusted easily by only moving bracket 54 vertically.

In the embodiment described herein, there are two blades for charging toner. Alternatively, however, three or four or more blades may be used with the same result. Preferably, in this case, $L_0 < L_1 < \ldots < L_n$ (n is the number of blades) should be fulfilled, in order to prevent toner from being scraped off.

What is claimed is:

1. A developing apparatus for developing ana electrostatic latent image by applying a developer to the latent image which is formed on the surface of an image carrier at a developing position facing the image carrier, comprising:

a housing for containing the developer;

a developer carrier for carrying the developer from the housing in a developer movement direction to the developing position; and a plurality of blades pressed against the developer carrier, said plurality of blades including a first blade making contact with said developer carrier at a first point and having a first end spaced from said developer carrier and located upstream, relative to said developer movement direction, from said first point by a first distance, and a second blade making contact with said developer carrier at a second point and having a second end spaced form said developer carrier and located upstream, relative to said developer movement direction, from said second point by a second distance, wherein said first point is upstream of said second point relative to said developer movement direction and said first distance is shorter than said second distance.

2. An apparatus according to claim 1, wherein said developer carrier includes a developing roller rotating in one direction, so that the first and second blades are arranged successively around the roller, between the housing and the developing position.

3. An apparatus according to claim 1, wherein said developer is a one-component nonmagnetic developer.

4. An apparatus according to claim 1, wherein said housing is provided, at the bottom portion thereof, with a recovery member for recovering residual toner particles on the developer carrier, so that the developer carrier is in contact with the recovery member at the entrance into the housing.

5. An apparatus according to claim 4, wherein said recovery member includes a recovery blade in the form of a thin plate, pressed against the developer carrier at the central portion thereof.

6. An apparatus according to claim 3, wherein the first blade has a proximal end portion attached to one part of the housing, and said second blade is attached to another part of the housing.

7. An apparatus according to claim 2, wherein said first and second blades have proximal end portions which are fixed together at a joint, and wherein the joint of the blades is attached to a part of the housing.

8. An apparatus according to claim 2, wherein the said first and second blades have proximal end portions which are attached to a lower end portion of the front frame by a bracket member.

9. An apparatus according to claim 8, wherein said first and second blades are attached bifurcately to the lower end portion of the bracket member.

10. A developing apparatus for developing an electrostatic latent image by applying a developer to the latent image which is formed on the surface of an image carrier at a developing position facing the image carrier, comprising:

a housing for containing the developer;

a developer carrier for carrying the developer from the housing in a developer movement direction to the developing position;

a feeding member disposed in the housing, and adapted to feed the developer in the housing to the developer carrier;

a first blade pressed against the developer carrier so as to apply the developer with a first pressure and to determine a thickness of the developer on the developer carrier; and a second blade pressed against the developer carrier with a second pressure which is less than the first pressure, said second blade following the first blade in said developer carrier direction.

11. An apparatus according to claim 10, wherein said feeding member includes a feed roller, whereby the developer flows toward the developer carrier as the feed roller rotates.

12. An apparatus according to claim 11, wherein said feed roller is in contact with the developer carrier.

13. An apparatus according to claim 12, wherein said feed roller rotates in a direction such that the surface of the feed roller and the surface of the developer carrier move opposite to each other, and have a point of contact therebetween.

14. An apparatus according to claim 10, wherein a baffle plate is disposed over the feeding member, whereby an upward flow of the developer is prevented.

15. An apparatus according to claim 14, wherein the free end of the first blade extends into a space surrounded by the baffle plate, the feeding member, and the developer carrier.

16. A developing apparatus for developing an electrostatic latent image by applying a developer to the latent image, comprising:

a housing for containing the developer;

a developer carrier for carrying the developer from the housing to the developing position;

a first blade having a proximal end portion attached to a part of the housing, and a free end portion pressed against the developer carrier with a first pressure to determine a thickness of said developer on said developer carrier, said first blade being adapted to hold the developer in the housing, between the housing and the developer carrier; and a second blade disposed outside of said housing and having an end portion pressed against the developer carrier with a second pressure which is less than the first pressure so that the second blade does not afffect said thickness of said developer on said developer carrier.

17. An apparatus according to claim 16, wherein said developer carrier includes a developing roller, so that first and second blades are arranged in the rotating direction of the roller, between the housing and the developing position.

18. An apparatus according to claim 17, wherein the distance from the point of contact between the first blade and the developing roller to one end of the first blade, directed against the rotating direction of the developing roller, is shorter than the distance from the point of contact between the second blade and the developing roller to one end of the second blade, directed against the rotating direction of the developing roller.

* * * * *